US010195875B2

(12) United States Patent
Hori et al.

(10) Patent No.: US 10,195,875 B2
(45) Date of Patent: Feb. 5, 2019

(54) PRINTING APPARATUS AND PRINTING METHOD

(71) Applicant: SEIKO EPSON CORPORATION, Tokyo (JP)

(72) Inventors: Naoki Hori, Shiojiri (JP); Masashi Kitahara, Matsumoto (JP); Shinji Kawakami, Azumino (JP); Atsushi Imamura, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/918,844

(22) Filed: Mar. 12, 2018

(65) Prior Publication Data

US 2018/0272758 A1 Sep. 27, 2018

(30) Foreign Application Priority Data

Mar. 23, 2017 (JP) ..... 2017-057141

(51) Int. Cl.
*B41J 11/00* (2006.01)
*B41J 2/045* (2006.01)

(52) U.S. Cl.
CPC ..... *B41J 11/0095* (2013.01); *B41J 2/04573* (2013.01)

(58) Field of Classification Search
CPC ..... B41J 2/04508; B41J 2/04586; B41J 11/0095; B41J 11/0085
See application file for complete search history.

(56) References Cited

U.S. PATENT DOCUMENTS 9,016,828 B2 * 4/2015 Yatsunami ..... B41J 29/393 347/19
2012/0242735 A1 9/2012 Izawa et al.

FOREIGN PATENT DOCUMENTS

JP 2012-200976 A 10/2012
JP 2014-009094 A 1/2014

* cited by examiner

*Primary Examiner* — Thinh H Nguyen
(74) *Attorney, Agent, or Firm* — Workman Nydegger

(57) ABSTRACT

A printing apparatus includes a transport unit which transports a recording medium in a transport direction; a printing unit which prints an image and a mark on the recording medium; and a mark detecting unit which is located on an upstream side of the printing unit in the transport direction, and detects a mark, includes a function of automatically adjusting a detecting sensitivity of the mark detecting unit, and obtains a printing start position using the mark, in which the mark detecting unit has a timer function including an ON delay in which a time between detecting of a mark and outputting of a detecting signal of ON is delayed, uses the timer function when obtaining the printing start position, and does not use the timer function when performing the automatic adjusting.

4 Claims, 6 Drawing Sheets

PRINTING APPARATUS AND PRINTING METHOD

BACKGROUND

1. Technical Field

The present invention relates to a printing apparatus and a printing method.

2. Related Art

In the related art, a printing apparatus which performs printing of a long recording medium, using a roll-to-roll transporting method of a long recording medium has been known. In such a printing apparatus, it is necessary to accurately perform positioning of a printing position between a stop and a restart of printing. For example, in JP-A-2012-200976, a printing apparatus in which a printing restart position is obtained by printing a timing mark on each image, a recording medium is forwardly sent again, after being backwardly sent, when restarting printing, and by counting the number of times of detecting a timing mark at a time of backward sending and a forward sending, using a mark sensor which optically detects the timing mark has been disclosed. However, in the printing apparatus, there has been a concern that a shift in printing start position may occur due to so-called chattering in which scattered light which is caused by a foreign substance such as wrinkle or dust on a recording medium, or an irregularity of the timing mark is erroneously detected. In JP-A-2014-9094, a method of suppressing an erroneous detection due to chattering, by delaying an output of a detecting signal which is output from a detecting unit is described with respect to the problem.

However, in order to correctly detect a mark using a mark detecting unit (mark sensor), it is necessary to adjust a detecting sensitivity in advance. In a case in which such adjusting is automatically performed, it is necessary to match the mark detecting unit and a center of a mark while detecting the mark by moving the recording medium or the mark detecting unit. At this time, since the recording medium or the mark detecting unit moves along with acceleration and deceleration, in a case in which an output of the output signal from the mark detecting unit is delayed, it is difficult to obtain a relative position between the mark detecting unit and the recording medium. Due to this, an adjusting failure of the mark detecting unit occurs, and there is a concern of causing a shift in printing position due to a decrease in detecting accuracy of a mark.

SUMMARY

The invention can be realized in the following aspects or application examples.

Application Example 1

According to this application example, there is provided a printing apparatus which includes a transport unit which transports a recording medium in a transport direction, a printing unit which prints an image and a mark on the recording medium, and a mark detecting unit which is located on an upstream side of the printing unit in the transport direction, and detects the mark, has a function of automatically adjusting a detecting sensitivity of the mark detecting unit, and obtains a printing start position using the mark, in which the mark detecting unit has a timer function including an ON delay in which a time between detecting of a mark and outputting of a detecting signal of ON is delayed, uses the timer function when obtaining the printing start position, and does not use the timer function when performing the automatic adjusting.

According to the application example, the mark detecting unit of the printing apparatus has the timer function of delaying a time between detecting of a mark and outputting of a detecting signal of ON. The printing apparatus does not use the timer function when automatically adjusting the mark detecting unit. In this manner, since a detection result in the mark detecting unit is output in real time, it is easy to perform positioning of the mark and the recording medium, and accuracy in adjusting and positioning of the mark detecting unit is improved. In addition, when obtaining a printing restart position based on the detection result of the mark, the timer function is used. In this manner, since the mark detecting unit does not output a detecting signal of ON with respect to a detection of a foreign substance, or the like, which is less than a delay time, it is possible to reduce so-called chattering in which a foreign substance, or the like, is erroneously detected as a mark. Accordingly, it is possible to provide a printing apparatus in which accuracy in printing position at a time of restarting printing is improved.

Application Example 2

In the printing apparatus, according to the application example, it is preferable that the timer function in the printing apparatus further include an OFF delay in which a time between not detecting a mark and outputting of a detecting signal of OFF is delayed.

According to the application example, the timer function includes the OFF delay, in addition to the ON delay. In a case in which only the ON delay is used, an output time of the detecting signal of ON becomes shorter than the time in which the mark detecting unit detects a mark; however, since the detecting signal of ON with the same time as the mark detecting time is output by using the OFF delay together, a detecting accuracy of the mark is improved.

Application Example 3

In the printing apparatus, according to the application example, it is preferable that the printing apparatus change a delay time of the timer function according to a transport speed of the recording medium which is transported by the transport unit.

According to the application example, the printing apparatus changes the delay time of the timer function according to the transport speed. For example, in a case in which the transport speed is set to two times, the delay time is set to a half, and in a case in which the transport speed is set to a half, the delay time is set to two times. In this manner, a distance of the recording medium which is transported during the delay time becomes constant. In other words, since occurrences of disturbance such as wrinkle or dust which is present in a delay time (in constant distance) also becomes the same, it is possible to obtain the same reducing effect of chattering, regardless of a transport speed of a recording medium.

Application Example 4

A printing method according to this application example is a printing method of a printing apparatus which includes a transport unit which transports a recording medium in a transport direction, a printing unit which prints an image and a mark on the recording medium, and a mark detecting unit which is located on an upstream side of the printing unit in the transport direction, and detects the mark, has a function of automatically adjusting a detecting sensitivity of the mark detecting unit, and obtains a printing start position using the mark, in which the mark detecting unit has the timer function including an ON delay in which a time between detecting of a mark and outputting of a detecting signal of ON is delayed, the method including performing the automatic adjusting without using the timer function; and detecting the mark for obtaining a printing start position using the timer function, after the performing of the automatic adjusting.

According to the application example, the printing method of the printing apparatus includes performing of the automatic adjusting without using the timer function, and detecting the mark for obtaining a printing start position using the timer function. In the performing of the automatic adjusting, since a detection result in the mark detecting unit is output in real time, it is easy to perform positioning of a mark and a recording medium, and adjusting accuracy and position accuracy of the mark detecting unit are improved. In addition, in the detecting of the printing start mark, since the mark detecting unit does not output a detecting signal of ON with respect to a detection of a foreign substance, or the like, which is less than a delay time, it is possible to reduce so-called chattering in which a foreign substance, or the like, is erroneously detected as a mark. Accordingly, it is possible to provide a printing method in which accuracy in printing position at a time of restarting printing is improved.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment of the invention will be described with reference to drawings.

Embodiment

Schematic Configuration of Printing Apparatus

Figure 1:
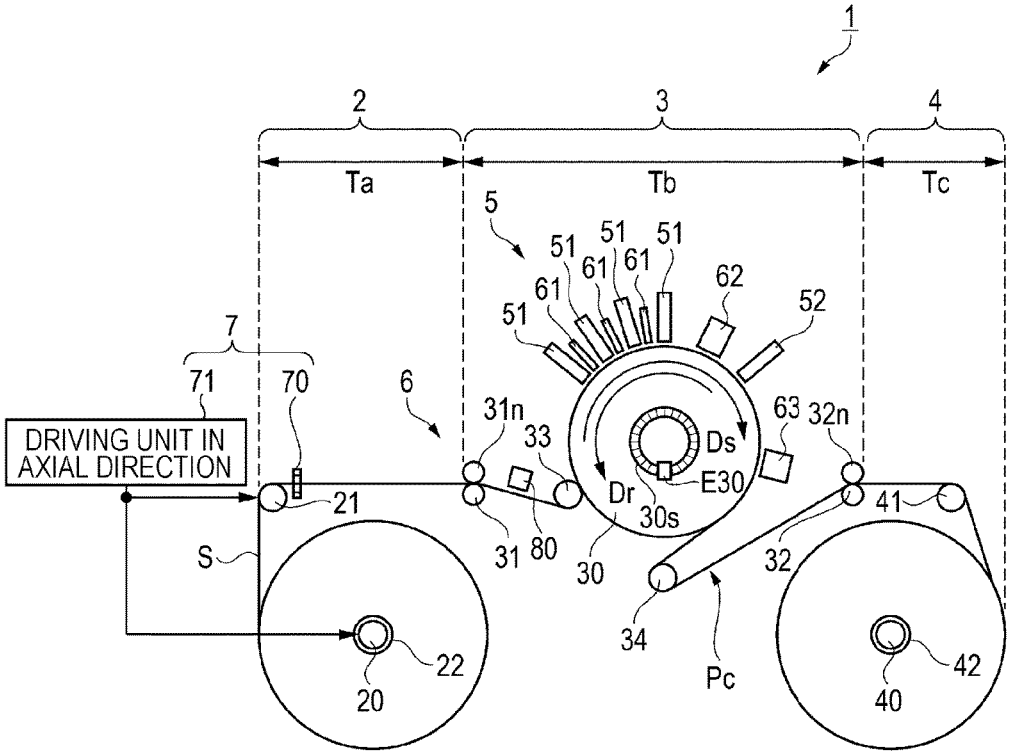
FIG. 1 is a schematic view which schematically illustrates the entire configuration of a printing apparatus according to an embodiment.

FIG. 1 is a schematic view which schematically illustrates the entire configuration of a printing apparatus according to the embodiment. First, a schematic configuration of a printing apparatus 1 according to the embodiment will be described with reference to FIG. 1. According to the embodiment, the printing apparatus 1 which is provided with a rotating drum 30 which supports a recording medium S in a cylindrical shape, and transports the recording medium S using a roll-to-roll method will be described as an example.

As illustrated in FIG. 1, the printing apparatus 1 is provided with a transport unit 6 which transports the recording medium S in a forward direction Ds which goes along a transport direction or a backward direction Dr which is opposite to the forward direction Ds, and a printing unit 5 which prints an image and a mark on the recording medium S. The transport unit 6 includes a sending shaft 20 which sends out the recording medium S, a front driving roller 31 and a rear driving roller 32 which transport the recording medium S, a rotating drum 30 which supports the recording medium S in a cylindrical shape, and a winding shaft 40 which winds up the recording medium S. In the embodiment, the sending shaft 20 side becomes an upstream side in the transport direction, and the winding shaft 40 side becomes a downstream side in the transport direction when transporting the recording medium S in the forward direction Ds. In addition, the winding shaft 40 side becomes the upstream side in the transport direction, and the sending shaft 20 side becomes the downstream side in the transport direction when transporting the recording medium S in the backward direction Dr. In addition, in the embodiment, when the transport direction of the recording medium S is referred to as the upstream side without designating the transport direction, the sending shaft 20 side is the upstream side, and when being referred to as the downstream side without designating the transport direction of the recording medium S, the winding shaft 40 side is the downstream side.

In the printing apparatus 1, a long recording medium S of which both ends are wound around the sending shaft 20 and the winding shaft 40 in a roll shape is stretched along a transport path Pc. The recording medium S receives recording of an image in the printing unit 5 while being transported in the forward direction Ds in the rotating drum 30 which is provided at a portion between the sending shaft 20 and the winding shaft 40. A type of the recording medium S is roughly classified into paper and a film. Specifically, there are fine paper, cast paper, art paper, coated paper, and the like, in the paper, and there are synthetic paper, polyethylene terephthalate (PET), polypropylene (PP), and the like, in the film. The printing apparatus 1 is schematically configured of three regions of a sending region 2 in which the recording medium S is send out from the sending shaft 20, a processing region 3 in which an image is recorded on the recording medium S which is sent out from the sending region 2, and a winding region 4 in which the recording medium S on which the image is recorded in the processing region 3 is wound around the winding shaft 40. In the following descriptions, a face on which the image is recorded is referred to as the front surface, and a face on a side opposite thereto is referred to as the rear face, in both faces of the recording medium S.

The sending shaft 20 around which one end of the recording medium S is wound, and a driven roller 21 which winds up the recording medium S pulled out from the sending shaft 20 are included in the sending region 2. The sending shaft 20 supports the recording medium S by winding one end thereof in a state in which the front surface of the recording medium S faces the outer side. In addition, when the sending shaft 20 rotates in clockwise in FIG. 1, the recording medium S wound around the sending shaft 20 is sent out to the processing region 3 via the driven roller 21. The driven roller 21 is a roller which rotates in a driven manner in the forward direction Ds or the backward direction Dr of the recording medium S by being in contact with the recording medium S, and receiving a frictional force between the roller and the transported recording medium S. Incidentally, the recording medium S is wound around the sending shaft 20 through a core tube 22 which can be detached from the sending shaft 20. Accordingly, when the recording medium S of the sending shaft 20 is used up, it is possible to exchange the recording medium S of the sending shaft 20, by mounting a new core tube 22 around with the roll-shaped recording medium S is wound on the sending shaft 20.

The printing apparatus 1 is provided with a steering unit 7 which corrects a movement of the recording medium S in an axial direction Da (direction perpendicular to paper face in FIG. 1) which intersects the forward direction Ds of the recording medium S when transporting the recording medium S in the forward direction Ds. Specifically, the sending shaft 20 and the driven roller 21 can move in the axial direction Da which is orthogonal to the forward direction Ds, and the steering unit 7 which suppresses meandering of the recording medium S by adjusting positions of the sending shaft 20 and the driven roller 21 to the axial direction Da (width direction of recording medium S) is provided in the sending region 2. The steering unit 7 is configured of an edge sensor 70 and a driving unit in axial direction 71.

The edge sensor 70 is provided at an end portion of the recording medium S in the axial direction Da on the downstream side of the driven roller 21 in the forward direction Ds, and detects a position of an end of the recording medium S in the axial direction Da. The edge sensor 70 includes a transmitter (not illustrated) which transmits an ultrasonic wave, and a receiver (not illustrated) which receives an ultrasonic wave. The transmitter and the receiver are disposed by interposing the recording medium S therebetween. The transmitter transmits an ultrasonic wave to a circular detecting region with a width of approximately 10 mm in the axial direction Da. The receiver receives the ultrasonic wave which passed through the detecting region.

The driving unit in axial direction 71 suppresses meandering of the recording medium S by adjusting positions of the sending shaft 20 and the driven roller 21 in the axial direction Da based on a detecting result of the edge sensor 70.

In the processing region 3, the recording medium S which is sent out from the sending region 2 is supported by the rotating drum 30, processing with respect to the recording medium S is appropriately performed by the printing unit 5 which is configured of recording heads 51 and 52, and UV irradiators 61, 62, and 63 which are disposed along the outer peripheral face of the rotating drum 30, and an image is recorded on the recording medium S. The front driving roller 31 as a driving roller which transports the recording medium S toward the rotating drum 30 is provided on the upstream side of the processing region 3, and a rear driving roller 32 which transports the recording medium S toward the winding shaft 40 is provided on the downstream side of the processing region 3. The recording medium S transported from the front driving roller 31 to the rear driving roller 32 is supported by the rotating drum 30.

The front driving roller 31 includes a plurality of fine protrusions which are formed using spraying on the outer peripheral face, and winds up the recording medium S which is sent out from the sending region 2 from the rear face side. In addition, when the front driving roller 31 rotates in clockwise in FIG. 1, the recording medium S which is sent out from the sending region 2 is transported to the downstream side of the transport path Pc. A nip roller 31*n* is provided by facing the front driving roller 31. The nip roller 31*n* comes into contact with the front surface of the recording medium S in a state of being urged to the front driving roller 31 side, and interposes the recording medium S between the roller and the front driving roller 31. In this manner, a frictional force between the front driving roller 31 and the recording medium S is secured, and it is possible to reliably perform transporting of the recording medium S using the front driving roller 31.

The rotating drum 30 is a cylindrical drum with a diameter of, for example, 400 mm, which is supported by a support mechanism (not illustrated), and winds up the recording medium S which is transported from the front driving roller 31 to the rear driving roller 32 from the rear face side. The rotating drum 30 rotates in a driven manner in the forward direction Ds of the recording medium S by receiving a frictional force between the drum and the recording medium S which is transported, while supporting the recording medium S from the rear face side. Incidentally, in the processing region 3, driven rollers 33 and 34 which change a travelling direction of the recording medium S on both sides in the forward direction Ds in a region in which the recording medium S is wound around the rotating drum 30 are provided. In these, the driven roller 33 turns back the travelling direction of the recording medium S toward the rotating drum 30 by winding up the front surface of the recording medium S between the front driving roller 31 and the rotating drum 30 in the forward direction Ds. Meanwhile, the driven roller 34 turns back the travelling direction of the recording medium S by winding up the front surface of the recording medium S between the rotating drum 30 and the rear driving roller 32 in the forward direction Ds. In this manner, it is possible to secure a long wound portion of the recording medium S around the rotating drum 30 by turning back the recording medium S on the upstream side and the downstream side in the forward direction Ds, respectively, with respect to the rotating drum 30.

A drum encoder E30 which outputs a signal which can be used when obtaining a transport position of the recording medium S using the transport unit 6 is provided in the rotating drum 30. Specifically, a disk-shaped rotary scale 30*s* is provided in the rotating shaft of the rotating drum 30. A magnetic scale in which magnets with different polarities are alternately disposed along a circumferential direction is used in the rotary scale 30*s* in the embodiment. The drum encoder E30 is provided at a position facing the rotary scale 30*s*. The drum encoder E30 is provided with an element which converts a change in a magnetic field into an electrical signal (for example, Hall element, MR element, or the like), and detects a relative movement amount with respect to the rotary scale 30*s*. That is, it is possible to obtain a transport position of the recording medium S (transport distance) from a signal denoting a rotating amount (displacement of angle) of the rotating drum 30 which is output from the drum encoder E30.

In addition, according to the embodiment, a configuration in which the transport position of the recording medium S is obtained using the drum encoder E30 which detects a rotation amount of the rotating drum 30 is described; however, it may be a configuration in which the transport position of the recording medium S is obtained, using an encoder which detects a rotation amount of the front driving roller 31 or the rear driving roller 32.

In addition, according to the embodiment, a so-called magnetic encoder in which a relative movement amount of the rotary scale 30*s* and the drum encoder E30 is obtained, using a change in magnetic field is exemplified; however, it may be an optical encoder which obtains a movement amount using an optical change.

The rear driving roller 32 has the plurality of fine protrusions which are formed using spraying, on the circumferential face, and winds up the recording medium S transported from the rotating drum 30 through the driven roller 34 from the rear face side. In addition, when the rear driving roller 32 rotates in clockwise in FIG. 1, the recording medium S is transported to the winding region 4. A nip roller 32*n* is provided by facing the rear driving roller 32. The nip roller 32*n* comes into contact with the front surface of the recording medium S in a state of being urged to the rear driving roller 32 side, and interposes the recording medium S between the nip roller and the rear driving roller 32. In this manner, a frictional force between the rear driving roller 32 and the recording medium S is secured, and it is possible to reliably perform transporting of the recording medium S using the rear driving roller 32.

In this manner, the recording medium S transported from the front driving roller 31 to the rear driving roller 32 is supported on the outer peripheral face of the rotating drum 30. In addition, a plurality of recording heads 51 corresponding to colors different from each other are provided in the printing unit 5, in order to record a color image on the front surface of the recording medium S which is supported by the rotating drum 30. According to the embodiment, four recording heads 51 corresponding to a yellow color, a cyan color, a magenta color, and a black color are aligned in the forward direction Ds in this order. Each of the recording heads 51 faces the front surface of the recording medium S which is wound around the rotating drum 30 with a slight interval, and ejects ink (color ink) of a corresponding color from a nozzle in the recording head using an ink jet method. In addition, a color image is formed on the front surface of the recording medium S, when each recording head 51 ejects ink onto the recording medium S which is transported in the forward direction Ds.

Incidentally, as ink, ultraviolet (UV) ink (photocurable ink) which is cured by being irradiated with an ultraviolet ray (light) is used. Therefore, the UV irradiators 61 and 62 are provided in the processing region 3, in order to fix ink on the recording medium S by curing thereof. In addition, curing of ink is performed by being divided into two stages of temporary curing and main curing. The UV irradiators 61 for temporary curing are disposed between the plurality of recording heads 51, respectively. That is, the UV irradiator 61 cures ink to an extent in which wet-spreading of the ink is sufficiently late (temporary curing), compared to a case of irradiating UV light, by irradiating UV light with low irradiating intensity, and does not perform main curing of the ink. Meanwhile, the UV irradiator 62 for main curing is provided on the downstream side of the plurality of recording heads 51 in the forward direction Ds. That is, the UV irradiator 62 cures (main curing) ink to an extent in which wet-spreading of the ink stops, by irradiating UV light with high irradiating intensity compared to the UV irradiator 61.

In this manner, the UV irradiators 61 which are respectively disposed between the plurality of recording heads 51 temporarily cure color ink which is ejected onto the recording medium S from the recording head 51 on the upstream side in the forward direction Ds. Accordingly, the ink ejected onto the recording medium S from the recording head 51 on the upstream side in the two recording heads 51 which are adjacent to each other is temporarily cured while reaching the recording head 51 on the downstream side, along with transporting of the recording medium S. Due to this, it is possible to prevent an occurrence of mixing of colors in which color ink of different colors are mixed. The plurality of recording heads 51 eject color ink different from each other in such a state in which mixing of colors is suppressed, and form a color image on the recording medium S. In addition, the UV irradiator 62 for main curing is provided on the downstream side of the plurality of recording heads 51 in the forward direction Ds. For this reason, the color image formed by the plurality of recording heads 51 is fixed to the recording medium S by being subjected to main curing by the UV irradiator 62.

The recording head 52 is provided on the downstream side of the UV irradiator 62 in the forward direction Ds. The recording head 52 faces the front surface of the recording medium S which is wound around the rotating drum 30 with a slight interval, and ejects transparent UV ink onto the front surface of the recording medium S from a nozzle using an ink jet method. That is, the transparent ink is further ejected to the color image formed by the recording heads 51 of four colors. The transparent ink is ejected to the entire face of the color image, and gives a texture such as glossiness or a feeling of mat to the color image. In addition, the UV irradiator 63 is provided on the downstream side of the recording head 52 in the forward direction Ds. The UV irradiator 63 performs main curing of the transparent ink ejected from the recording head 52, by irradiating UV light with higher irradiating intensity than that of the UV irradiator 61. In this manner, it is possible to fix the transparent ink onto the front surface of the recording medium S.

In this manner, in the processing region 3, ejecting and curing of ink are appropriately performed with respect to the recording medium S which is wound around the rotating drum 30 at the outer peripheral portion, and a color image applied with a texture using transparent ink is formed. In addition, the recording medium S on which the color image is formed is transported to the winding region 4 using the rear driving roller 32.

In the processing region 3, the mark detecting unit 80 which is located on the upstream side of the printing unit 5 in the transport direction (forward direction Ds), and detects the mark MK (refer to FIG. 6) is provided. The mark detecting unit 80 is disposed between the front driving roller 31 and the driven roller 33. The plurality of marks MK are printed along with an image in order to obtain a timing for restarting printing which is temporarily stopped, and the mark detecting unit 80 detects a mark MK on the recording medium S which is transported for restarting printing. Here, the plurality of marks MK are not limited to be printed along with an image, and may be provided on the recording medium S in advance.

The mark detecting unit 80 is a reflective photo sensor provided with a light output unit (not illustrated) which outputs light, and a light receiving unit (not illustrated) which receives light. The light output unit is configured of, for example, a light emitting diode, a tungsten lamp, or the like, and a region which is spot-irradiated on the recording medium S becomes a detecting region 85 (refer to FIG. 6) which detects a mark MK. The light receiving unit is, for example, configured of an optical sensor such as a photodiode, receives light which is output, and is reflected in the detecting region 85 on the recording medium S, and outputs a voltage value corresponding to a light receiving amount thereof. In this manner, it is possible to detect a mark MK which reaches inside the detecting region 85.

The mark detecting unit 80 has the timer function of delaying a time for outputting the detecting signal. The timer function in the embodiment includes an ON delay in which a time between detecting of the mark MK and outputting of a detecting signal of ON is delayed, and an OFF delay in which a time between not detecting of a mark and outputting of a detecting signal of OFF is delayed.

In addition, the mark detecting unit 80 includes a movement mechanism (not illustrated), and is configured so as to move in the axial direction Da which intersects the forward direction Ds. As the movement mechanism, for example, a mechanism in which a ball screw and a ball nut are combined, a linear guide mechanism, or the like, can be adopted.

The winding region 4 includes a driven roller 41 which winds up the recording medium S at a portion between the winding shaft 40 and the rear driving roller 32 from the rear face side, in addition to the winding shaft 40 around which the other end of the recording medium S is wound. The winding shaft 40 supports the other end of the recording medium S by winding thereof in a state in which the front surface of the recording medium S faces the outer side. That is, when the winding shaft 40 rotates in clockwise in FIG. 1, the recording medium S transported from the rear driving roller 32 is wound around the winding shaft 40 through the driven roller 41. Incidentally, the recording medium S is wound around the winding shaft 40 through the core tube 42 which can be detachable from the winding shaft 40. Accordingly, when the recording medium S wound around the winding shaft 40 is full, it is possible to detach the recording medium S in each core tube 42.

Figure 2:
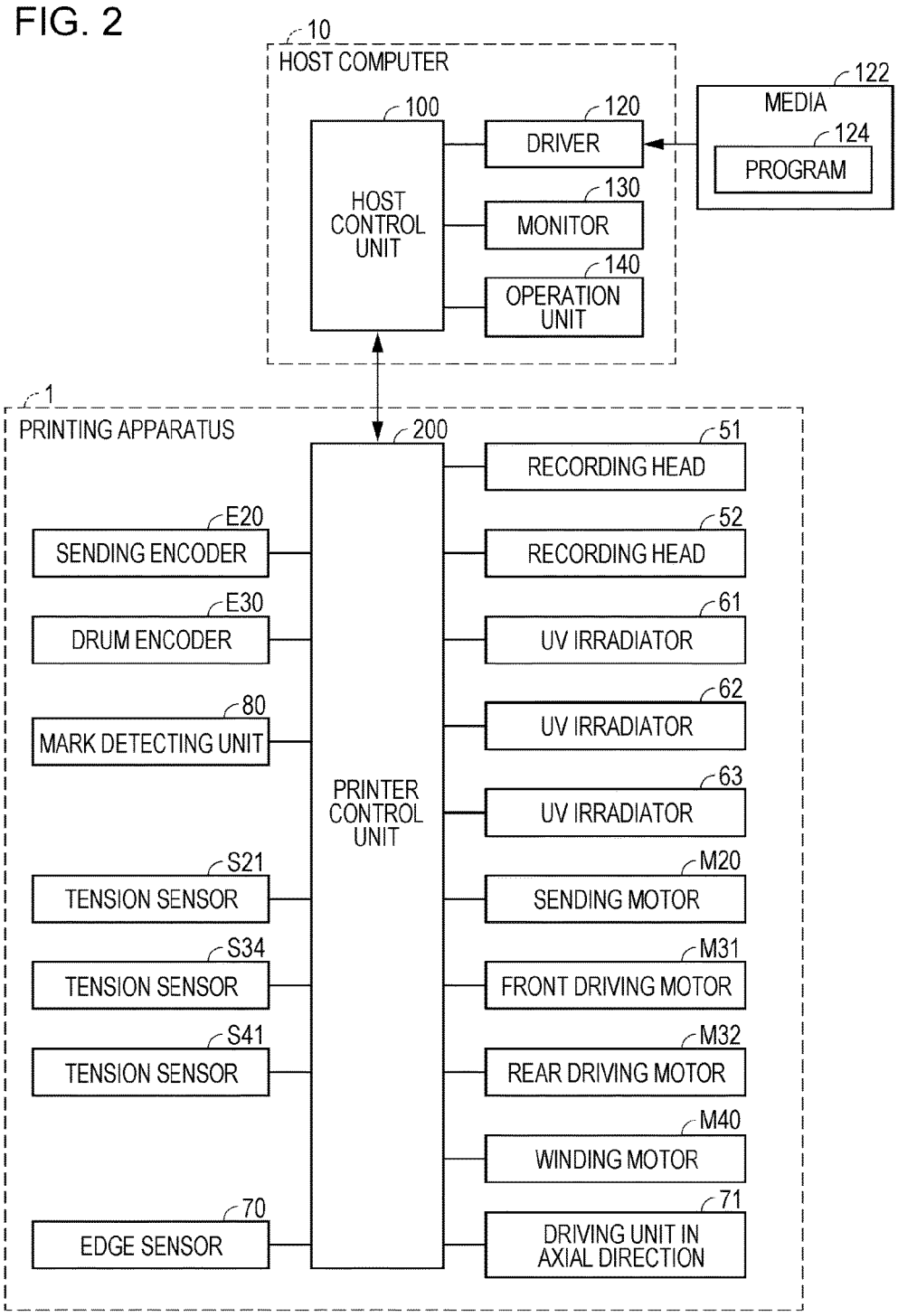
FIG. 2 is a block diagram which schematically illustrates an electrical configuration for controlling the printing apparatus.

Subsequently, an electrical configuration of controlling the printing apparatus 1 will be described. FIG. 2 is a block diagram which schematically illustrates the electrical configuration for controlling the printing apparatus. An operation of the above described printing apparatus 1 is controlled by the host computer 10 illustrated in FIG. 2. The host computer 10 may be provided in the printing apparatus 1, or may be provided out of the printing apparatus 1, separately from the printing apparatus 1. In the host computer 10, a host control unit 100 which integrates a control operation is configured of a central processing unit (CPU) or a memory. In addition, the host computer 10 includes a driver 120, and the driver 120 reads a program 124 from media 122. As the media 122, it is possible to use various media such as a compact disk (CD), a digital versatile disk (DVD), and a Universal Serial Bus (USB). In addition, the host computer 100 controls each unit of the host computer 10 or an operation of printing apparatus 1, based on the program 124 which is read from the media 122.

In addition, a monitor 130 which is configured of a liquid crystal display, or the like, and an operation unit 140 configured of a keyboard, a mouse, or the like, are provided in the host computer 10 as an interface with an operator. A menu screen is displayed on the monitor 130, in addition to an image as a printing target. Accordingly, the operator can set various printing conditions such as a type of a recording medium, a size of the recording medium, and a printing quality by opening a printing setting screen from a menu screen by operating the operation unit 140 while checking the monitor 130. A specific configuration of the interface with the operator can be variously changed, and for example, the operation unit 140 may be configured using a touch panel of the monitor 130 by using a touch panel display as the monitor 130.

Meanwhile, the printing apparatus 1 is provided with a printer control unit 200 as a control unit which controls each unit of the printing apparatus 1 according to an instruction from the host computer 10. In addition, the recording heads 51 and 52, the UV irradiators 61, 62, and 63, and each unit of the transport unit 6 are controlled by the printer control unit 200. A detailed control of the printer control unit 200 with respect to the each unit is as follows.

The printer control unit 200 is configured of a CPU (not illustrated) for performing processing of an input signal from various detectors, or the like, and a control of the printing apparatus 1, a storage unit (not illustrated) for securing an area for storing a program or a work area of the CPU, or the like.

The printer control unit 200 controls an ink ejecting timing of each recording head 51 which forms a color image according to transporting of the recording medium S. Specifically, a control of the ink ejecting timing is executed based on an output (detected value) of the above described drum encoder E30. That is, since the rotating drum 30 rotates in a driven manner along with transporting of the recording medium S, it is possible to grasp a transport position of the recording medium S from an output value (rotation position, rotation amount) of the drum encoder E30. Therefore, the printer control unit 200 generates a print timing signal (pts) from an output of the drum encoder E30, causes ink ejected from each recording head 51 to landed on a target position of the recording medium S which is transported, by controlling an ink ejecting timing of each of recording heads 51 based on the Pts signal, and forms a color image.

Also a timing of ejecting the transparent ink by the recording head 52 is controlled by the printer control unit 200 based on an output of the drum encoder E30, similarly. In this manner, it is possible to exactly eject transport ink to a color image which is formed by the plurality of recording heads 51. In addition, also a timing of ON and OFF, or irradiation light intensity of the UV irradiators 61, 62, and 63 is controlled by the printer control unit 200.

The printer control unit 200 takes charge of function of controlling transporting of the recording medium S which is described using FIG. 1. That is, in each of units which configures the transport unit 6, motors are connected to the sending shaft 20, the front driving roller 31, the rear driving roller 32, and the winding shaft 40, respectively. In addition, the printer control unit 200 controls transporting of the recording medium S by controlling a speed or a torque of each motor while rotating these motors. A detail of transporting control of the recording medium S is as follows.

The printer control unit 200 supplies the recording medium S from the sending shaft 20 to the front driving roller 31 by rotating a sending motor M20 as a driving unit which drives the sending shaft 20. At this time, the printer control unit 200 adjusts a tension of the recording medium S (sending tension Ta) from the sending shaft 20 to the front driving roller 31 by controlling a driving force (torque) of the sending motor M20. That is, a tension sensor S21 as a detecting unit which detects the sending tension Ta is attached to the driven roller 21 which is disposed between the sending shaft 20 and the front driving roller 31 in the forward direction Ds. The tension sensor S21 can be configured of, for example, a load cell which detects a force received from the recording medium S. In addition, the printer control unit 200 adjusts the sending tension Ta of the recording medium S by performing a feedback control of the torque of the sending motor M20, based on a detection result of the tension sensor S21. In addition, the printer control unit 200 also controls the number of rotations of the sending shaft 20 based on an output (detected value) of a sending encoder E20 which detects the number of rotations of the sending shaft 20, by being attached to the sending shaft 20 when starting printing. The control of the number of rotations of the sending shaft 20 may be controlled based on an output of an encoder built in the sending motor M20, instead of the sending encoder E20.

The printer control unit 200 rotates a front driving motor M31 which drives the front driving roller 31, and a rear driving motor M32 which drives the rear driving roller 32. Due to this, the recording medium S which is sent out from the sending region 2 passes through the processing region 3. At this time, a speed control is performed with respect to the front driving motor M31, and meanwhile, a torque control is performed with respect to the rear driving motor M32. That is, the printer control unit 200 adjusts a rotation speed of the front driving motor M31 so as to be constant based on an encoder output of the front driving motor M31. In this manner, the recording medium S is transported at a constant speed by the front driving roller 31.

Meanwhile, the printer control unit 200 adjusts a tension of the recording medium S (processing tension Tb) from the front driving roller 31 to the rear driving roller 32 by controlling a torque of the rear driving motor M32. That is, a tension sensor S34 which detects the processing tension Tb is attached to the driven roller 34 which is disposed between the rotating drum 30 and the rear driving roller 32 in the forward direction Ds. The tension sensor S34 can be configured of a load cell which detects a force received from the recording medium S, for example. In addition, the printer control unit 200 adjusts the processing tension Tb of the recording medium S by performing a feedback control of the torque of the rear driving motor M32 based on a detection result of the tension sensor S34.

The printer control unit 200 winds the recording medium S transported by the rear driving roller 32 around the winding shaft 40 by rotating a winding motor M40 which drives the winding shaft 40. At this time, the printer control unit 200 adjusts a tension of the recording medium S (winding tension Tc) from the rear driving roller 32 to the winding shaft 40 by controlling a torque of the winding motor M40. That is, a tension sensor S41 which detects the winding tension Tc is attached to the driven roller 41 which is disposed between the rear driving roller 32 and the winding shaft 40 in the forward direction Ds. The tension sensor S41 can be configured of a load cell which detects a force received from the recording medium S, for example. In addition, the printer control unit 200 adjusts the winding tension Tc of the recording medium S by performing a feedback control of the torque of the winding motor M40 based on a detection result of the tension sensor S41.

In addition, the printer control unit 200 has a function of controlling in the above described steering unit 7 which is provided in the sending region 2, and adjusts an end position of the recording medium S in the axial direction Da to a target position (hereinafter, referred to as steering correction), by performing a feedback control of the driving unit in axial direction 71 based on a detection result of the edge sensor 70. In addition, the target position is set so that positions of center lines of the front driving roller 31 and the rear driving roller 32 match a center line of the recording medium S in the axial direction Da. Accordingly, the recording medium S is transported in the forward direction Ds so that the center line of the recording medium S passes through the center lines of the front driving roller 31 and the rear driving roller 32. In this manner, since a load which the recording medium S receives from a nip formed by the front driving roller 31 and the rear driving roller 32 becomes uniform in the axial direction Da, it is possible to transport the recording medium S in the forward direction Ds while suppressing the recording medium S biased in the axial direction Da.

In addition, the printer control unit 200 moves the mark detecting unit along the axial direction Da by controlling the movement mechanism of the mark detecting unit 80 based on the detection result of the edge sensor 70 when transporting the recording medium S in the backward direction Dr. In this manner, the mark detecting unit 80 can detect a mark on the recording medium S, even in transporting of the recording medium S in the backward direction Dr in which the steering correction does not work.

Hitherto, an outline of the electrical configuration for controlling the printing apparatus was described. Subsequently, the timer function of the mark detecting unit 80 will be described in detail.

Figure 3:
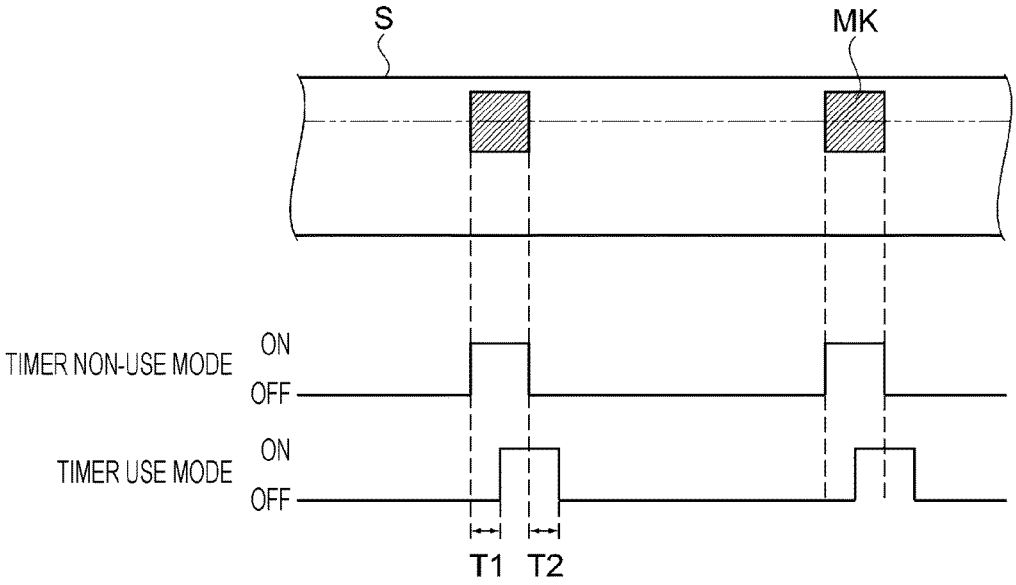
FIG. 3 is a time chart which describes a detecting signal which is output from a mark detecting unit.
Figure 4:
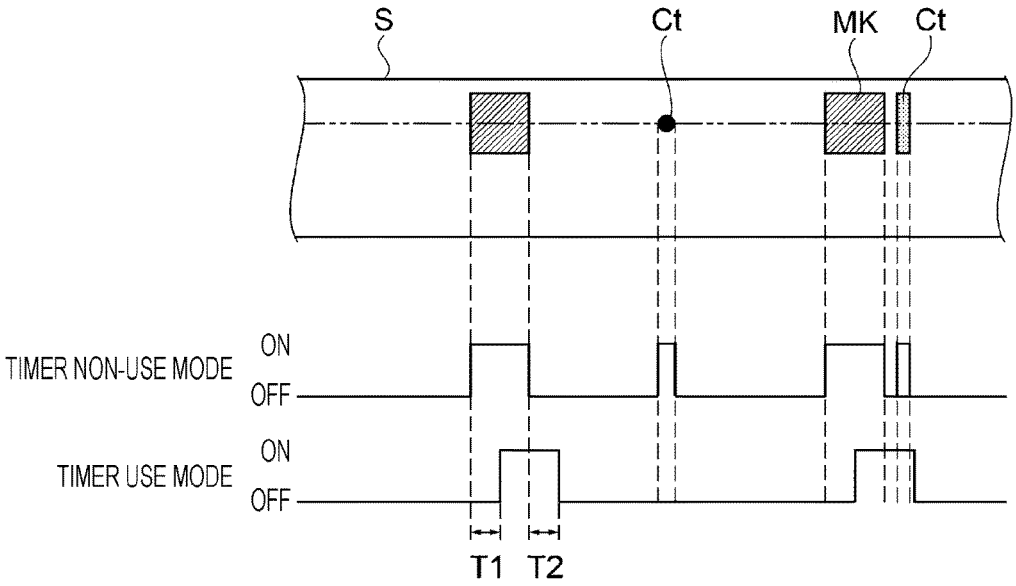
FIG. 4 is a time chart which describes a detecting signal which is output from a mark detecting unit.

FIGS. 3 and 4 are time charts which describe a detecting signal output from the mark detecting unit. In addition, in FIGS. 3 and 4, traces in relative movement of the recording medium S and the detecting region 85 of the mark detecting unit 80 is denoted by a two dot-dashed line. Subsequently, the timer function of the mark detecting unit 80 will be described with reference to FIGS. 3 and 4.

The upper stage in FIG. 3 denotes a position of a mark MK which is formed on the recording medium S. The middle stage denotes a detecting signal of the mark MK which is detected in the mark detecting unit 80 when the detecting region 85 moves on the two dot-dashed line, in a timer non-use mode in which the timer function is not used. The lower stage denotes a detecting signal of a mark MK which is detected in the mark detecting unit 80 when the detecting region 85 moves on the two dot-dashed line in a timer use mode in which the timer function is used. The mark detecting unit 80 outputs a detecting signal of ON (hereinafter, referred to as ON signal) when the mark MK is detected, and outputs a detecting signal of OFF (hereinafter, referred to as OFF signal) when the mark MK is not detected, that is, when the recording medium S is detected.

In the timer non-use mode, the mark detecting unit 80 outputs the ON signal at the same time as detecting of the mark MK, and outputs the OFF signal at the same time as non-detecting of the mark MK (detecting of recording medium S).

In the timer use mode, the mark detecting unit 80 detects a mark MK using the ON delay, outputs an ON signal in a case in which a detecting state is continued for a predetermined delay time (ON delay time) T1, and outputs an OFF signal after a predetermined delay time (OFF delay time) T2 has passed, in a case in which the mark MK is not detected from the state of outputting the ON signal, using the OFF delay. There is a case in which an output time of the ON signal becomes extremely shorter than a time in which the mark detecting unit 80 detects the mark MK, when only the ON delay is used. Therefore, in the printing apparatus 1 according to the embodiment, the OFF delay is used together. Since it is possible to output the ON detecting signal which is the same as that in a detecting time of a mark MK by using the OFF delay together, a detecting accuracy of the mark MK is improved. In addition, it is possible to obtain an output of the ON signal with the same length as a mark detecting time, by setting a length of the delay time T1 at a time of the ON delay to be the same as that of the delay time T2 at a time of OFF delay.

Since a configuration of the diagram in FIG. 4 is the same as that in FIG. 3, descriptions thereof will be omitted. In FIG. 4, a detecting signal which is output from the mark detecting unit 80 in a case in which a foreign substance Ct such as wrinkle or dust is present on a detecting region of the recording medium S is denoted. In the timer non-use mode, since the mark detecting unit 80 outputs an ON signal simultaneously with detecting of the foreign substance Ct, the printer control unit 200 misrecognizes the signal as a mark MK. Meanwhile, in the timer use mode, the mark detecting unit 80 does not output the ON signal, since a time in which the foreign substance Ct is detected is less than the ON delay time T1. That is, it is possible to reduce so-called chattering in which a foreign substance, or the like, is erroneously detected as a mark MK, by driving the mark detecting unit 80 in the timer use mode.

The printing apparatus 1 according to the embodiment is provided with a function of automatically adjusting the detecting sensitivity of the mark detecting unit 80. The printer control unit 200 moves the recording medium S in the forward direction Ds or the backward direction Dr when causing the first mark MK to be detected in the mark detecting unit 80, moves the mark detecting unit 80 in the axial direction Da, and matches the detecting region 85 of the mark detecting unit 80 and a center of the mark MK, after detecting an end portion of the mark MK. In addition, the printer control unit 200 adjusts an intensity of light output from the mark detecting unit 80, and obtains a threshold value which outputs the ON signal or the OFF signal, based on a received light intensity which is detected in the mark MK and a received light intensity which is detected in the recording medium S. In this manner, the threshold value is appropriately set, and a detecting accuracy for detecting a mark MK is improved.

However, since the recording medium S and the mark detecting unit 80 move along with acceleration and deceleration when automatically adjusting the detecting sensitivity, it is difficult to obtain a relative position between the mark detecting unit 80 and the recording medium S, in a case in which the mark detecting unit 80 is driven in the timer use mode. In addition, in order to accurately obtain the relative position between the mark detecting unit 80 and the recording medium S, it is necessary to perform a complicated calculation by providing an accelerometer. Therefore, the printing apparatus 1 according to the embodiment has a function of switching the mark detecting unit 80 between the timer use mode and the timer non-use mode, and when automatically adjusting the detecting sensitivity, the printer control unit 200 drives the mark detecting unit 80 by switching thereof to the timer non-use mode. In this manner, since a detection result in the mark detecting unit 80 is output in real time, it is easy to position the mark MK and the recording medium S, and a position accuracy and an adjusting accuracy of the mark detecting unit 80 are improved.

Printing Method

In the printing apparatus 1 with the roll-to-roll method, there is a case in which printing is stopped due to maintenance, or the like, of the apparatus. Subsequently, a printing method when restarting printing after stopping printing of the printing apparatus 1 will be described.

Figure 8:
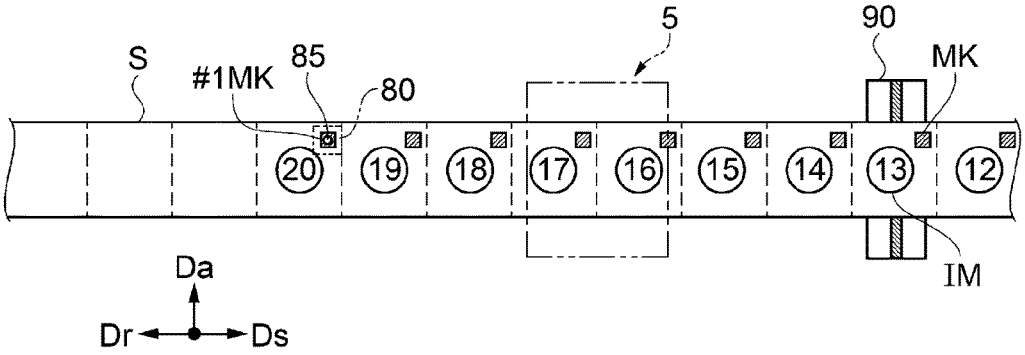
FIG. 8 is a diagram which illustrates a relative position among the printing unit, the mark detecting unit, and the recording medium.
Figure 9:
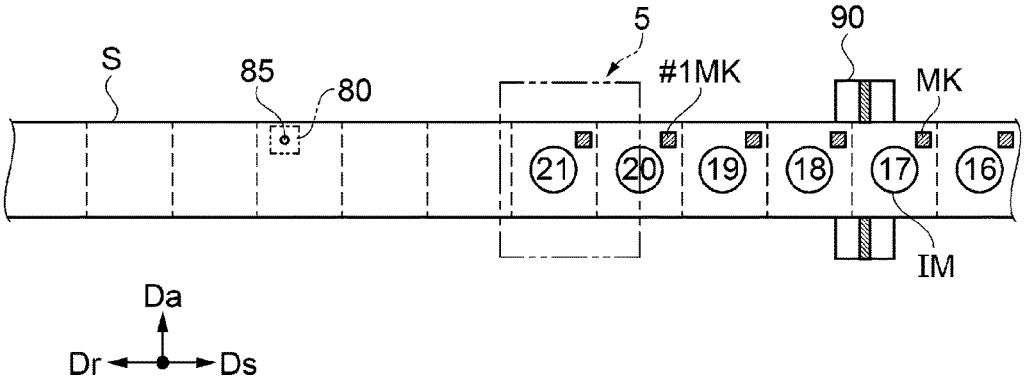
FIG. 9 is a diagram which illustrates a relative position among the printing unit, the mark detecting unit, and the recording medium.
Figure 10:
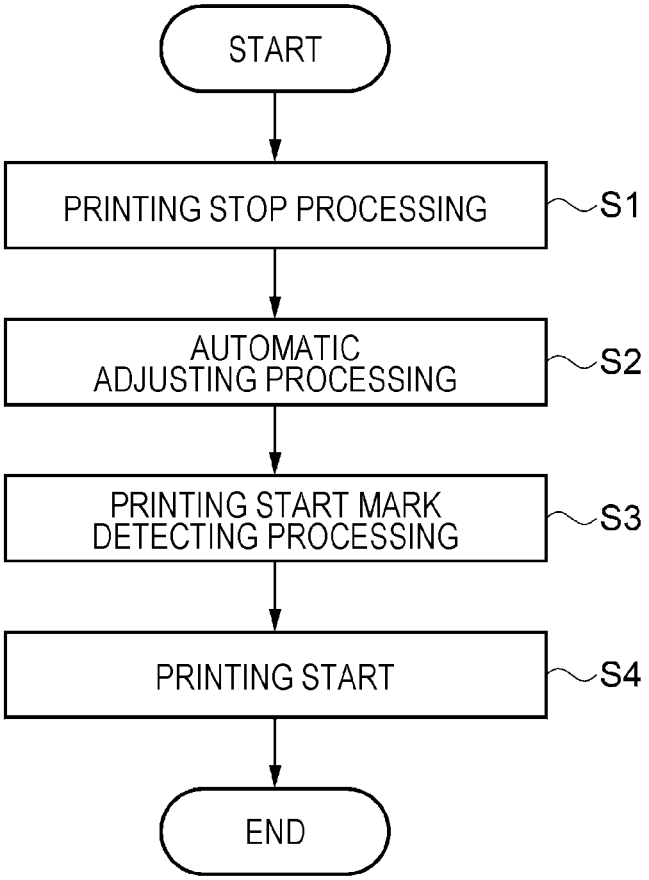
FIG. 10 is a flowchart which illustrates a printing method.

FIGS. 5 to 9 are diagrams which illustrate a relative position among the printing unit, the mark detecting unit, and the recording medium. FIG. 10 is a flowchart which illustrates a printing method when printing of the printing apparatus 1 is stopped, and is restarted. In addition, FIGS. 5 to 9 illustrate a plan view in which the recording medium S which is transported along the transport path Pc is planarized, and positions of the printing unit 5 and the mark detecting unit 80 are denoted by a two dot-dashed line. In addition, in the recording medium S, a section in which the image IM is printed is denoted by a dashed line. A printing method when restarting printing in the printing apparatus 1 will be described with reference to FIGS. 5 to 10.

Step S1 is a printing stop processing in which printing is stopped. For example, in a case in which an operation of stopping printing is performed by the operation unit 140 by a user, the printer control unit 200 receives a printing stop signal from the host computer 10, and causes printing operation of the printing apparatus 1 to be stopped.

Figure 5:
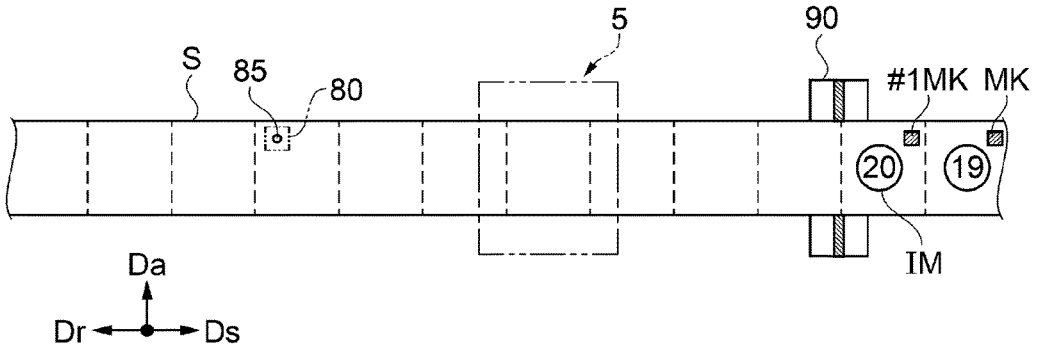
FIG. 5 is a diagram which illustrates a relative position among a printing unit, the mark detecting unit, and a recording medium.

FIG. 5 illustrates a position of the recording medium S when printing of the printing apparatus 1 is stopped. The printer control unit 200 transports the recording medium S to a predetermined stop position in the forward direction Ds, and stops printing, after printing the twentieth image IM. The predetermined stop position is, for example, set to a cutting position of a cutting table 90 for cutting an end portion of the final (twentieth) image IM on the sending side (upstream side). In addition, the plurality of marks MK as pairs of each image IM are printed in parallel on the recording medium S in the forward direction Ds.

Figure 6:
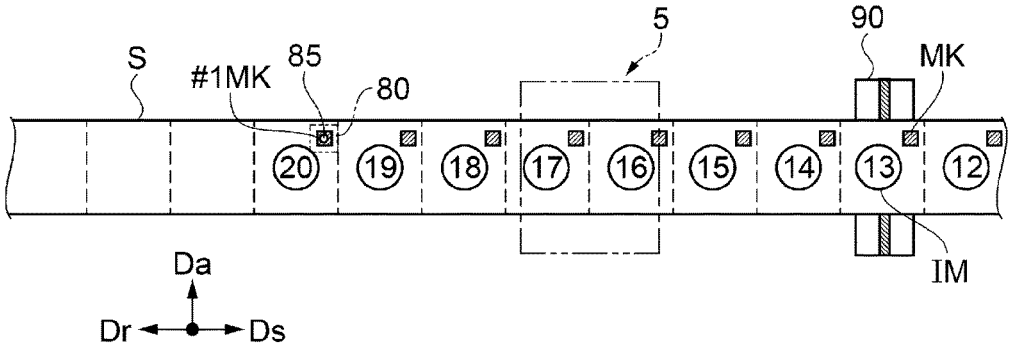
FIG. 6 is a diagram which illustrates a relative position among the printing unit, the mark detecting unit, and the recording medium.

Step S2 is automatic adjusting processing in which automatic adjusting is performed in the timer non-use mode in which the timer function is not used. FIG. 6 illustrates an automatic adjusting position of the mark detecting unit 80. The printer control unit 200 drives the mark detecting unit 80 in the timer non-use mode, transports the recording medium S in the backward direction Dr based on an output value of the drum encoder E30, and performs automatic adjusting of the mark detecting unit 80 using the first mark 1MK which is printed along with the twentieth image IM. For example, the mark MK is formed in a square shape with appropriately 5 mm square, and the detecting region 85 is formed in a circular shape of appropriately 1 mm.

The printer control unit 200 moves the recording medium S along the backward direction Dr, detects an edge of the first mark 1MK, and obtains a center of the first mark 1MK in the forward direction Ds by further moving the recording medium S by 2.5 mm therefrom. In addition, the printer control unit 200 moves the mark detecting unit 80 along the forward direction Ds, detects the edge of the first mark 1MK, and obtains the center of the first mark 1MK in the forward direction Ds by further moving the recording medium S by 2.5 mm therefrom. Since the mark detecting unit 80 is driven in the timer non-use mode, it is possible to easily match the first mark 1MK and a center of the mark detecting unit 80. In addition, the printer control unit 200 obtains a threshold value of the mark detecting unit 80 from a light receiving amount of the recording medium S which is detected in the middle of transporting from FIG. 5 to FIG. 6, and a light receiving amount of the mark MK which is detected in the center of the first mark 1MK.

Step S3 is printing start mark detecting processing in which the first mark 1MK for obtaining the printing start position is detected by switching from the timer non-use mode to the timer use mode in which the timer function is used. The printer control unit 200 switches the mark detecting unit 80 to the timer use mode, and transports the recording medium S in the backward direction Dr by a distance L1 from the state illustrated in FIG. 6 to the state illustrated in FIG. 7 based on an output value of the drum encoder E30. At this time, the printer control unit 200 measures the number of marks MK which is detected in the mark detecting unit 80. Since the mark detecting unit 80 is driven in the timer use mode, it is possible to reduce instances in which a foreign substance is erroneously detected as a mark MK. In addition, the distance L1 is set to a distance which is necessary when a shifted amount of the recording medium S in the axial direction Da is corrected by the steering unit 7 between transporting of the recording medium S in the forward direction Ds and reaching the detecting region 85 of the first mark 1MK. In this manner, meandering of the recording medium S in the axial direction Da is corrected by the steering unit 7 by transporting the recording medium S in the forward direction Ds until printing is started.

In addition, the printer control unit 200 changes the ON delay time T1 and the OFF delay time T2 according to a transport speed of the recording medium S which is transported by the transport unit 6. For example, in a case in which the transport speed is set to two times, the ON, OFF delay time T1, T2 is set to a half, and in a case in which the transport speed is set to a half, the ON, OFF delay time T1, T2 is set to two times. In this manner, a distance of the recording medium S which is transported during the ON, OFF delay time T1, T2 becomes constant. In other words, since occurrences of disturbance such as wrinkle or dust which is present in the ON, OFF delay time T1, T2 (within constant distance) becomes the same, it is possible to obtain the same effect of reducing chattering, regardless of the transport speed of the recording medium S.

Figure 7:
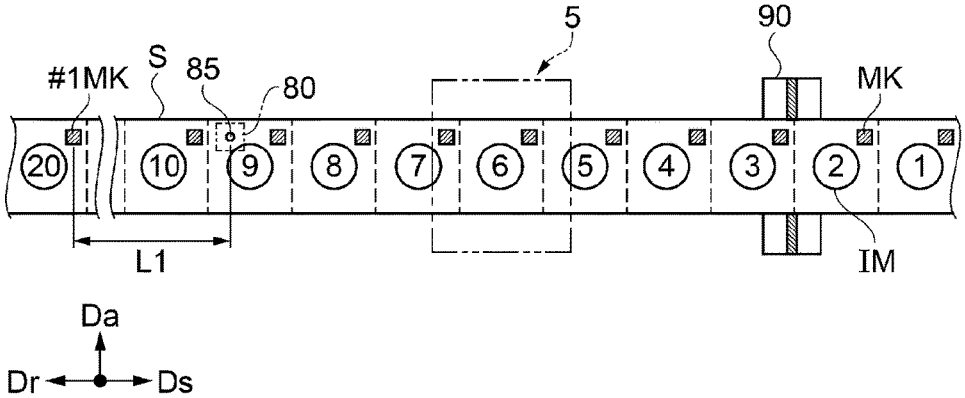
FIG. 7 is a diagram which illustrates a relative position among the printing unit, the mark detecting unit, and the recording medium.

Subsequently, the printer control unit 200 transports the recording medium S in the forward direction Ds from the state in FIG. 7, and obtains the first mark 1MK while measuring the number of marks MK which is detected in the mark detecting unit 80. The state at this time is illustrated in FIG. 8. At this time, a shift of the recording medium S in the axial direction Da is corrected by the steering unit 7.

Step S4 is printing start processing in which printing is restarted. The printer control unit 200 starts printing of the image IM using the printing unit 5 based on a timing in which the first mark 1MK is detected. In this manner, as illustrated in FIG. 9, the twenty-first image IM and thereafter are printed in a predetermined section, after the twentieth image IM.

The invention is not limited to the above described embodiment, and various modifications can be added to the above described embodiment without departing from the scope of the invention. In the above described embodiment, a case in which the invention is applied to the printing apparatus 1 in which the recording medium S is supported by the cylindrical rotating drum 30 has been exemplified; however, the configuration of supporting the recording medium S is not limited to this. For example, it may be a printing apparatus with a configuration of planarly supporting the recording medium S. The invention can be applied to the entire printing apparatus which performs printing in which the recording medium S is transported by the roll-to-roll method.

The number, a disposal, ejecting colors, or the like, of recording heads 51 and 52 can be appropriately changed. Also the number, a disposal, intensity of UV light, or the like, of the UV irradiators 61 to 63 can be appropriately changed. In addition, the transporting type of the recording medium S can be appropriately changed.

According to the embodiment, the invention is applied to the printing apparatus 1 provided with the recording heads 51 and 52 which eject UV ink. However, the invention may be applied to a printing apparatus provided with a printing head which ejects water based ink such as resin ink, for example. Alternatively, the invention may be applied to a printing apparatus which performs printing using a material other than ink such as a toner.

As described above, according to the printing method in the embodiment, it is possible to obtain the following effects.

The printing apparatus 1 includes the function of automatically adjusting the mark detecting unit 80, and the function of switching the mark detecting unit 80 between the timer use mode and the timer non-use mode. The printer control unit 200 drives the mark detecting unit 80 by switching thereof to the timer non-use mode when automatically adjusting the mark detecting unit 80. In this manner, since a detection result of the mark detecting unit 80 is output in real time, it is easy to perform positioning of the mark MK and the recording medium S, and position accuracy and adjusting accuracy of the mark detecting unit 80 are improved. In addition, the printer control unit 200 drives the mark detecting unit 80 by switching thereof to the timer use mode when detecting a mark MK. In this manner, in a case in which a time of detecting the foreign substance Ct, or the like, is less than the ON delay time T1, since an ON signal is not output in the mark detecting unit 80, it is possible to reduce so-called chattering in which a foreign substance, or the like, is erroneously detected as the mark MK. Accordingly, it is possible to provide the printing apparatus 1 in which printing position accuracy is improved at a time of restarting printing.

The mark detecting unit 80 has the timer function of the ON delay and the OFF delay. By setting the ON delay time T1 and the OFF delay time T2 to be the same length, the detecting accuracy of the mark MK is improved, since it is possible to obtain an output of an ON signal with the same length as the mark detecting time.

The printer control unit 200 of the printing apparatus 1 changes the ON delay time T1 and the OFF delay time T2 of the timer function according to a transport speed of the recording medium S. For example, in a case in which the transport speed is set to two times, the ON, OFF delay time T1, T2 is set to a half, and in a case in which the transport speed is set to a half, the ON, OFF delay time T1, T2 is set to two times. In this manner, a distance of the recording medium which is transported during the delay time becomes constant. In other words, since occurrences of disturbance such as wrinkle or dust which is present in the ON, OFF delay time T1, T2 (in constant distance) also becomes the same, it is possible to obtain the same reducing effect of chattering, regardless of the transport speed of the recording medium S.

The printing method of the printing apparatus 1 includes the automatic adjusting processing in which automatic adjusting is performed in the timer non-use mode in which the timer function is not used, and the printing start mark detecting processing of detecting the first mark 1MK for obtaining a printing position by switching from the timer non-use mode to the timer use mode in which the timer function is used. In this manner, in the automatic adjusting processing, since a detection result in the mark detecting unit 80 is output in real time, it is easy to perform positioning of the mark MK and the recording medium S, and the position accuracy and the adjusting accuracy of the mark detecting unit 80 are improved. In addition, in the printing start mark detecting processing, since the mark detecting unit 80 does not output the ON signal in a case in which a time of detecting a foreign substance Ct, or the like, is less than the ON delay time T1, it is possible to reduce so-called chattering in which the foreign substance, or the like, is erroneously detected as a mark MK. Accordingly, it is possible to provide a printing method in which accuracy in printing position when restarting printing is improved.

This application claims priority under 35 U.S.C. § 119 to Japanese Patent Application No. 2017-057141, filed Mar. 23 2017. The entire disclosure of Japanese Patent Application No. 2017-057141 is hereby incorporated herein by reference.

What is claimed is:

1. A printing apparatus comprising:

a transport unit which transports a recording medium in a transport direction;

a printing unit which prints an image and a mark on the recording medium; and a mark detecting unit which is located on an upstream side of the printing unit in the transport direction, and detects the mark, wherein the printing apparatus has a function of automatically adjusting a detecting sensitivity of the mark detecting unit, and obtains a printing start position using the mark, and wherein the mark detecting unit has a timer function including an ON delay in which a time between detecting of a mark and outputting of a detecting signal of ON is delayed, uses the timer function when obtaining the printing start position, and does not use the timer function when performing the automatic adjusting.

2. The printing apparatus according to claim 1, wherein the timer function in the printing apparatus further includes an OFF delay in which a time between not detecting a mark and outputting of a detecting signal of OFF is delayed.

3. The printing apparatus according to claim 1, wherein the printing apparatus changes a delay time of the timer function according to a transport speed of the recording medium which is transported by the transport unit.

4. A printing method of a printing apparatus which includes a transport unit which transports a recording medium in a transport direction, a printing unit which prints an image and a mark on the recording medium, and a mark detecting unit which is located on an upstream side of the printing unit in the transport direction, and detects the mark, has a function of automatically adjusting a detecting sensitivity of the mark detecting unit, and obtains a printing start position using the mark, wherein the mark detecting unit has the timer function including an ON delay in which a time between detecting of a mark and outputting of a detecting signal of ON is delayed, the method comprising:

performing the automatic adjusting without using the timer function; and detecting the mark for obtaining a printing start position using the timer function, after the performing of the automatic adjusting.

* * * * *